United States Patent [19]

Huydts et al.

[11] 4,207,763

[45] Jun. 17, 1980

[54] SCREW PRESS

[75] Inventors: Eduard J. C. Huydts, Düsseldorf; Helmut Dischler, Neuss, both of Fed. Rep. of Germany

[73] Assignee: G. Siempelkamp GmbH & Co., Krefeld, Fed. Rep. of Germany

[21] Appl. No.: 974,493

[22] Filed: Dec. 26, 1978

[30] Foreign Application Priority Data

Jan. 12, 1978 [DE] Fed. Rep. of Germany ..... 2801139

[51] Int. Cl.[2] ..... B21J 9/18

[52] U.S. Cl. ..... 72/454; 100/289

[58] Field of Search ..... 72/454; 100/289, 270; 192/103 C; 83/631

[56] References Cited

U.S. PATENT DOCUMENTS

| | | | |
|---|---|---|---|
| 3,376,728 | 4/1968 | Nemessanyi | 72/454 |
| 3,426,574 | 2/1969 | Voronak | 100/289 |
| 3,769,905 | 11/1973 | Dischler | 100/289 |
| 3,786,743 | 1/1974 | Dischler | 100/289 |

FOREIGN PATENT DOCUMENTS

| | | | |
|---|---|---|---|
| 2218090 | 10/1973 | Fed. Rep. of Germany | 100/289 |
| 2110044 | 4/1974 | Fed. Rep. of Germany | 72/454 |

*Primary Examiner*—Francis S. Husar

*Assistant Examiner*—Gene P. Crosby

*Attorney, Agent, or Firm*—Berman, Aisenberg & Platt

[57] ABSTRACT

A screw press comprising a flywheel rotatable continuously in one direction and a pneumatically operated coupling, selectively operable to couple the flywheel to the screw for a working stroke, wherein the coupling has a pressure chamber supplied by way of a one-way valve and dischargeable by the action of an inertial mass which rotates with the screw during its working stroke and inertially relative to the screw at the end of the working stroke to open a discharge orifice of the pressure chamber. A valve piston is moveable axially of the screw in a cylindrical recess, serving as an input chamber for supply air, which valve piston projects into a second chamber, connected to the atmosphere and having an opening, coverable by the valve piston, for supply and discharge of the pressure chamber. The valve piston is provided with at least one through passage having a one-way valve for feeding air from the cylindrical recess input chamber to the pressure chamber, and having a servo-valve operable by the inertial movement of the inertial mass to discharge the input chamber to the atmosphere, the resulting pressure differential across the valve piston causing it to open the pressure chamber discharge orifice.

7 Claims, 6 Drawing Figures

SCREW PRESS

BACKGROUND OF THE INVENTION

1. Field of the Invention

The invention relates to screw presses and is particularly applicable to screw presses having a flywheel continuously rotatable in one direction and a pneumatically actuated coupling between the flywheel and the screw, the coupling having a pressure chamber supplied by way of a one-way valve and dischargeable by means of a mass which, under idling or inertial action moves axially of the screw, the resulting axial movement opening the discharge duct of the pressure chamber of the coupling.

2. Description Of The Prior Art

Such a screw press is known, German Auslegeschrift No. 21 10 044, FIG. 6), in which the compressed air is supplied to the pressure chamber by way of a central passage, controlled by a one-way valve, which is connected to the pressure chamber by branch pipes. In addition, the branch pipes are connected to outlets which open out at a face of the coupling, upon which is also disposed the inertially movable mass. This mass is a ring, which is supported on the screw by a non-reversible tooth formation and which in addition, is biased in the axial direction by a spring. At the end of a working stroke, the rotation of the screw is arrested, while the ring rotates further due to its inertia. On account of the interposed screw, the ring lifts, against the action of the spring, away from the outlet of the pressure chamber, so that the compressed air present in the pressure chamber can flow through the outlet.

It has been found that, at the end of the working stroke, the ring does not lift from the outlet quickly enough to bring about an immediate discharge of the pressure chamber and therewith a prompt release of the coupling. Rather, the aperture is gradually uncovered by the ring and accordingly, the compressed air can only flow or stream slowly out of the pressure chamber. Hence, the coupling is slowly released and still drags after the end of the working stroke. That leads to undesirable wear of the coupling and to excessive loading of the press after the end of the working stroke. Furthermore, the operation of the control mechanism for the coupling is dependent upon the speed of rotation of the screw, which during the working stroke drives the ring and in that way determines its inertial idling action relative to the spring force.

In addition, the operation of the known screw press in the case of an emergency stop also leaves something to be desired. For practical embodiments one can install in the central passage for the compressed air supply a multi-way valve or the like, which is operated on the occasion of an emergency stop and makes possible discharging of the pressure chamber. There too, one achieves only a comparatively slow discharge of the pressure chamber, because the available cross-section of the central passage for the pressure fluid supply is restricted. Generally, it is known to effect a quick pressure discharge through a balanced valve.

OBJECTS AND SUMMARY OF THE INVENTION

An object of the invention is to achieve a quick discharge of the pressure chamber of a screw press at the end of a working stroke and/or in case of an emergency stop.

Accordingly, in embodiments of the present invention, there is provided a valve piston movable axially of the screw in a corresponding cylinder, serving as an input chamber for the air supply, which valve piston projects into a second chamber, connected to the atmosphere and having an opening coverable by the valve piston, for supply and discharge of the pressure chamber, the valve piston being provided with at least one through passage provided with a one-way valve for feeding air from the first chamber to the pressure chamber, and having a servo-valve operable by said inertial movement of the mass to discharge the first chamber to the atmosphere wherein the effective area of the coverable opening is only slightly less than the piston surface of the valve piston acted upon by the input air.

In a screw press according to the present invention, the control of the coupling, especially the discharge of the pressure chamber, takes place under defined conditions. An inertial mass is used, as in the prior art, which reacts upon retardation of the screw rotation. However, the mass no longer directly controls the opening in the pressure chamber, but rather, actuates the servo-valve in the valve piston, which opens discharge channels leading from the side of the piston valve acted upon by the input compressed air, and thus releases the compressed air to the atmosphere.

The pressure in the pressure chamber acts upon the opposite side of the piston valve. Hence, there is produced on the piston valve a pressure difference, which rapidly lifts the piston valve from the opening of the pressure chamber and thus allows compressed air present in the pressure chamber to escape to the atmosphere. Thus, the pressure chamber is discharged very quickly and accordingly, the coupling is released very quickly.

These circumstances apply also for an emergency stop, when the pressure side of the piston valve or the corresponding cylindrical chamber is connected to the atmosphere, because then too the pressure difference is present at the piston valve, leading to a prompt discharge of the pressure chamber.

An advantage of the present invention is that all compressed-air-carrying channels can have comparatively large cross-sections enabling quick filling or discharging of the pressure chamber for actuation of the coupling. This also applies for the through passage in the piston valve for supplying compressed air to the pressure chamber, in which there is arranged a one-way valve, that prevents a reverse flow of the compressed air and therewith a deterioration of the pressure difference.

If several through passages are provided, they can be arranged in a circle coaxial to the piston valve, and emerge into an annular groove having therein an annular member movable axially as a one-way valve.

Conveniently the servo-valve is arranged coaxially in the piston valve and the latter has a conical seating for a conical valve part whose valve lifter extends sealingly in a bore through the piston valve such that the free end of the valve lifter is impinged upon by the movable mass. This conical arrangement is especially advantageous where essential parts of the control mechanism, as well as the servo-valve are accommodated in the rotating flywheel. Then the discharge passages can also open out below the valve seating and be radially arranged. Finally, all compressed air carrying passages can be formed with sufficient cross-section.

The movable mass can be a known ring which has on one side an axial tooth formation for engagement with a corresponding tooth formation on the screw. The teeth preferably have a triangular or trapezoidal profile with a flank arranged in the axial direction and a flank arranged at an angle thereto. In that way a separate screw thread on the screw itself can be dispensed with and the arrangement of the ring relative to the screw or relative to the remaining parts of the coupling need not be unduly restricted. In particular, a movable pin can be arranged between the ring and the valve lifter. In order to ensure that the toothing of the ring remains continually in engagement with the corresponding toothing of the screw, i.e. in order to ensure that the engagement of the two cooperating sets of teeth is not interrupted, an axial stop for the ring can be provided.

BRIEF DESCRIPTION OF THE DRAWINGS

Various objects, features and attendant advantages of the present invention will be more fully appreciated as the same becomes better understood from the following detailed description thereof when considered in connection with the accompanying drawings, in which.

DETAILED DESCRIPTION OF THE PREFERRED EMBODIMENT

Figure 1:
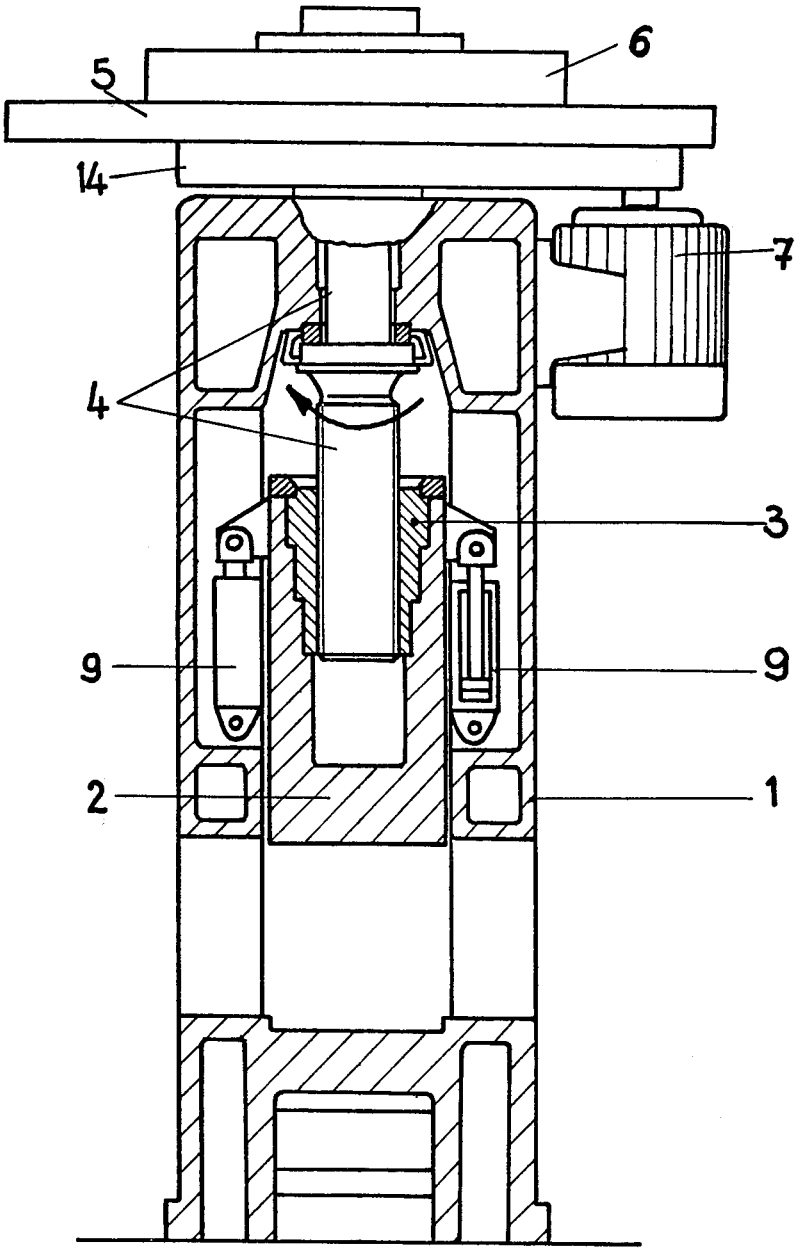
FIG. 1 is a general view of a screw press, partly in section.

The screw press shown in FIG. 1 has a column 1, in which a ram 2 is movable upwards and downwards. The ram 2 is carried, by way of a nut 3, by a screw 4, by whose rotation in the direction of the arrow, the nut 3 and therewith the ram 2, is moved downwards. Hydraulic cylinders 9 are provided for upward movement of the ram 2.

At the head of the screw press, a flywheel 5 is supported for rotation about the same axis as the screw 4. The flywheel 5 can be set in rotation by a motor 7 by way of a belt drive 14.

Between screw 4 and flywheel 5 is connected a coupling 6 by means of which the screw 4 can be coupled to the rotating flywheel 5 and, after the desired pressing operation has been effected, can be uncoupled again from the flywheel. The flywheel 5 is supported on the press column 1 in a known manner.

Figure 2:
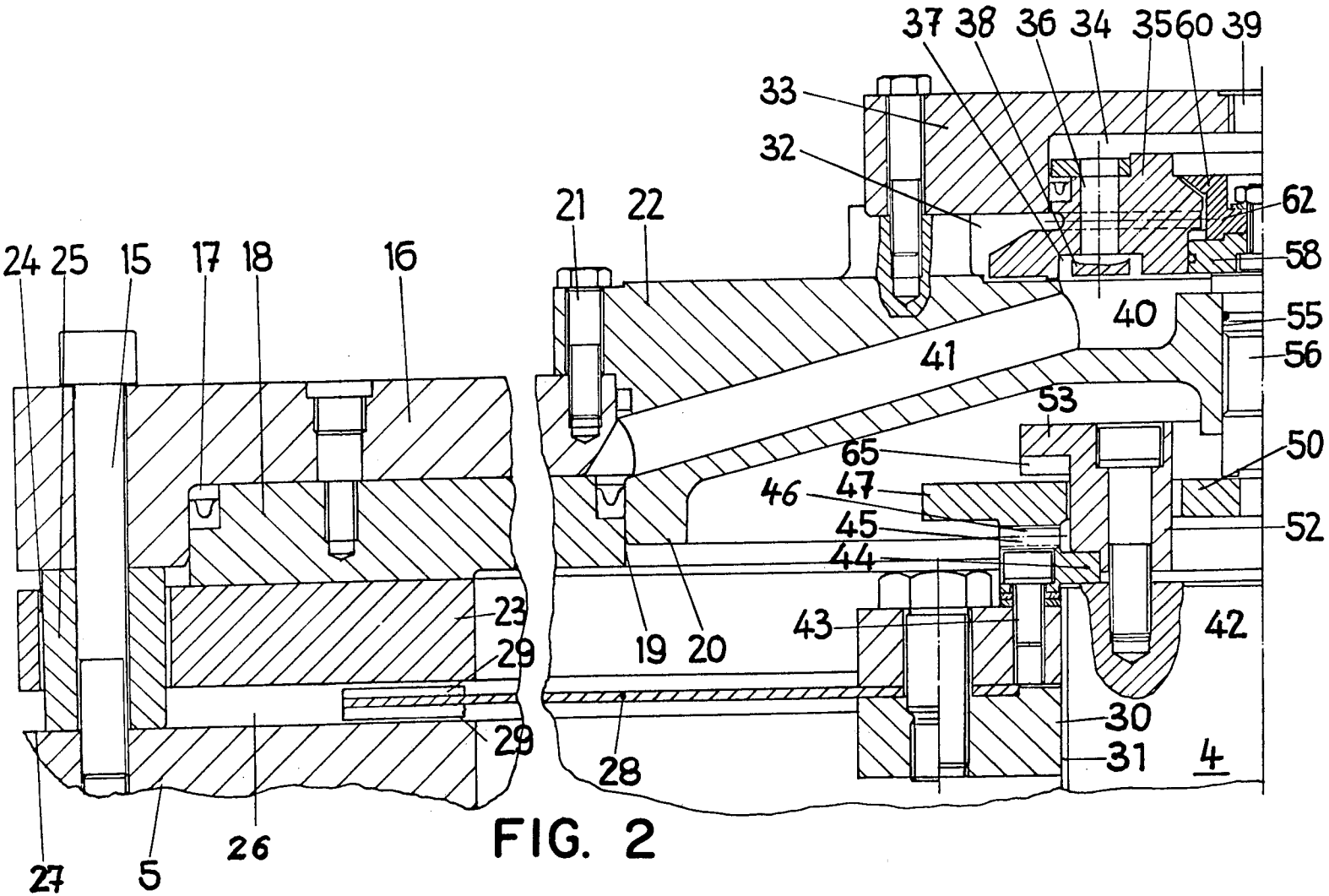
FIG. 2 is an axial section to a larger scale, through the upper part of a coupling of the screw press according to FIG. 1.

Referring now to FIG. 2, a housing part 16 is bolted to the upper side of the flywheel 5 by a screw connection 15. The housing part 16 is formed internally as a cylinder 17 receiving piston 18, sealed movably therein. The piston 18 is annular in shape and its inner circumferential surface 19 is slidingly sealed to an axially projecting flange 20 of a further housing part 22 fastened to the housing part 16 by means of a screw connection 21. The housing parts 16 and 22 are annularly shaped and arranged coaxially with respect to one another as well as with respect to screw 4.

At the underside of the piston 18 is arranged a thrust ring 23, which has at its periphery bores 24 through which extend sleeves 25 which surround the screws 15.

Between the annular clearance 26 between the thrust ring 23 and the upper side 27 of the flywheel mass 5 extends a clutch plate 28, which at its outer circumference carries on both sides friction linings 29. The clutch plate 28 is clamped to a hub 30, which in turn is secured in an axially movable manner to the screw 4 by a key 31.

The housing part 22 has a central recess, chamber 32, which is closed by a cover 33 bolted to the housing part 22. The cover 33 contains a cylindrical recess 34 for a valve piston 35 movable sealingly therein and slidable in the axial direction. The valve piston 35 has an annular seal rim with which it can bear upon the housing part 22, and several axial through passages 36, arranged in a circle coaxial to the screw axis. The passages 36 emerge at the underside of the valve piston 35 into an annular groove 37, in which is located an axially movable annular washer 38, which acts as a one-way valve.

Compressed air for operation of the coupling 6 can be supplied by way of a central hole 39 in the cover 33. The compressed air passes into the cylindrical recess 34 and by way of the through passages 36 and the one-way valve formed by the annular washer 38 and the annular groove, into an annular chamber 40, provided beneath the mouths of the through passages 36, in the housing part 22. The compressed air leaves the chamber 40 by way of radially extending ducts 41 which extend outwardly to end above the piston 18 located in the cylinder 17. The applied compressed air accordingly acts upon the piston 18, which moves downwards and thereby clamps the clutch plate 28 with its friction lining 29 between the thrust ring 23 and the upper side 27 of the flywheel 5, so that the screw 4 is driven.

The coupling is released as follows: At the free head end 42 of the screw 4, a ring 44 is fastened to the hub 30 by a screw 43. At its upper side the ring 44 has an annular tooth formation 45 with teeth projecting in the axial direction, which teeth have one flank arranged in the axial direction and the other flank arranged at an angle thereto. This tooth formation 45 is in engagement with corresponding radial toothing 46 of an idler ring 47.

Figure 4:
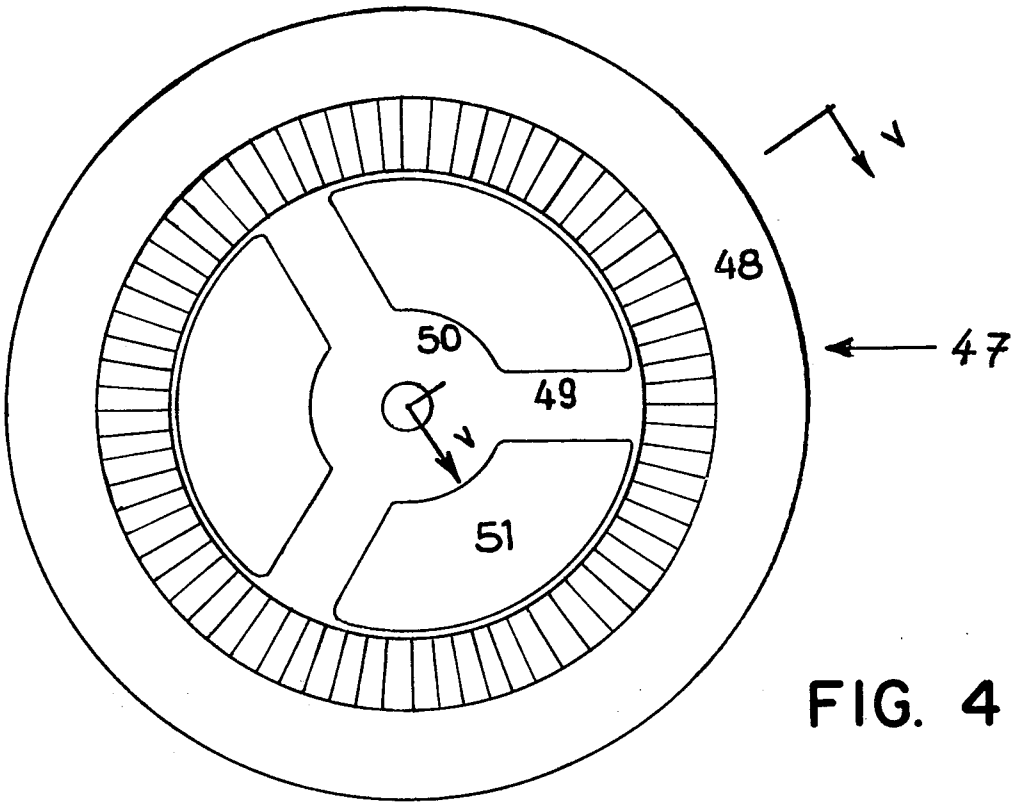
FIG. 4 is a plan view of a part of the coupling according to FIG. 2.
Figure 5:
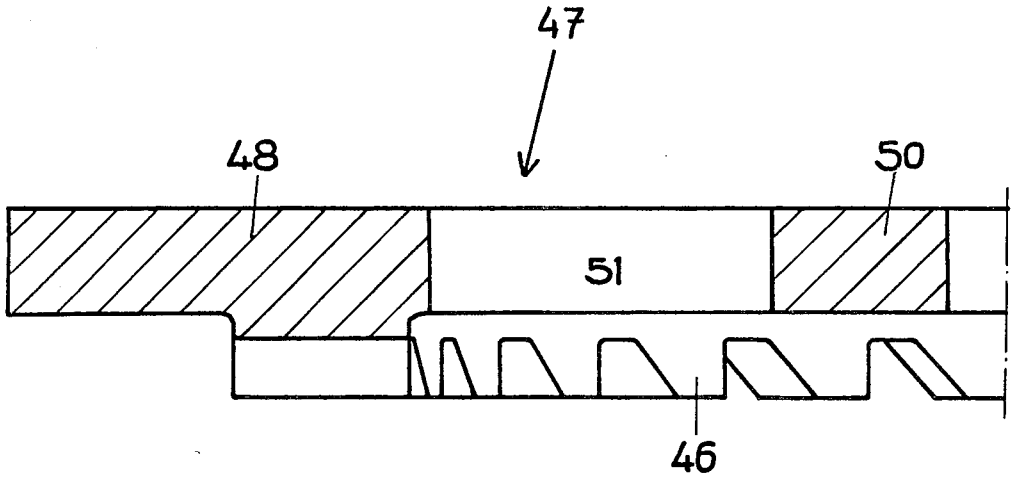
FIG. 5 is a section, as indicated by arrows V—V through the part shown in FIG. 4.
Figure 6:
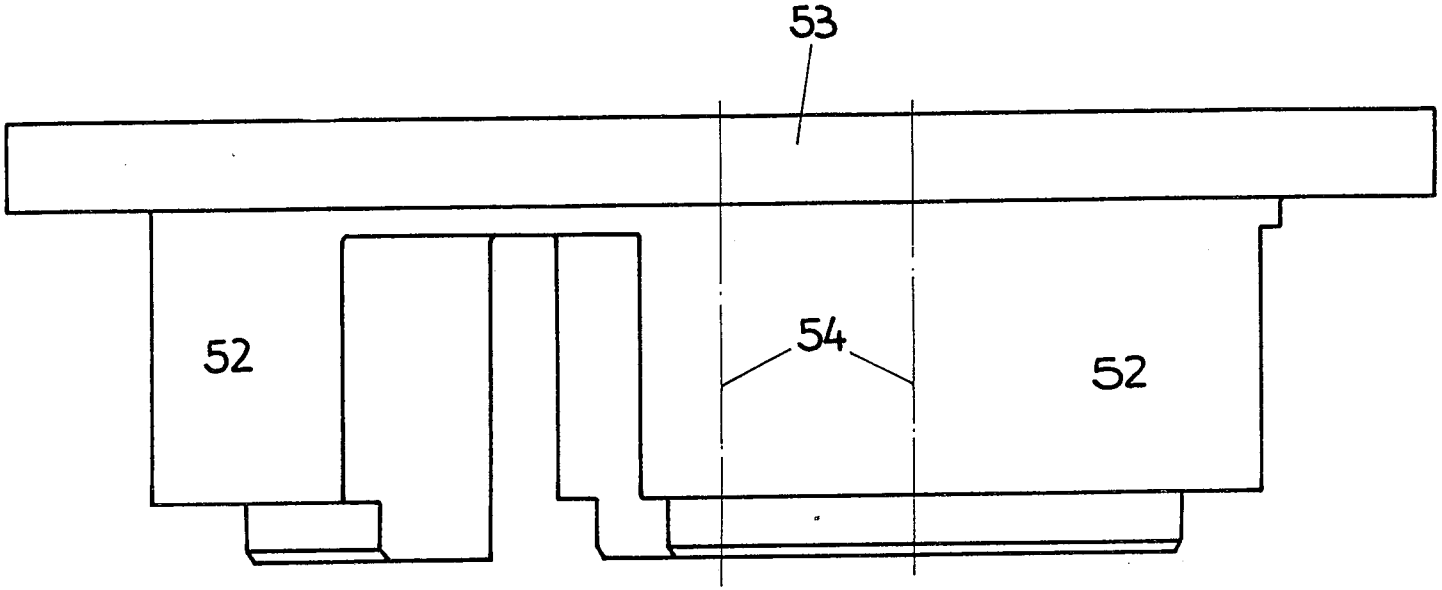
FIG. 6 is a side elevation of a part of the coupling shown in FIG. 2.

The idler ring 47 consists, as can be taken from FIGS. 4 and 5, of a ring 48 having on its underside the tooth formation 46 and is connected by spokes 49 to a hub 50. There are openings 51 between the spokes 49 through which the feet 52 of flange 53 extend in a axial direction, as can be taken from FIG. 6. Flange 53 is connected to the head end 42 of screw 4 by screws 54 which pass through the feet 52. Furthermore, flange 53 has at its lower side, which is directed towards the idler ring 47, a stop 65 for cooperation with the idler ring 47. The openings 51 in the idler ring 47 are large enough to allow the idler ring 47 an amount of rotation relatively to flange 53 during which rotation the tooth formation 45 and the radial toothing 46 slide on each other which results in an axial displacement of idler ring 47 towards flange 53. Stop 65, however, restricts the above mentioned axial displacement so that tooth formation 45 and radial toothing 46 cannot disengage.

In the case of a power stroke of the press, the idler ring 47 is at first driven by the screw 4, because in this direction of rotation (shown by the arrow in FIG. 1) the axial flanks of the tooth formations 45/46 bear upon one another. When the screw slows at the end of the power stroke, the idler ring 47 further rotates relative to the screw 4, whereby the inclined flanks of the tooth formations 45/46 slip upon one another and the idler ring 47 moves axially until it abuts against the stop 65.

Figure 3:
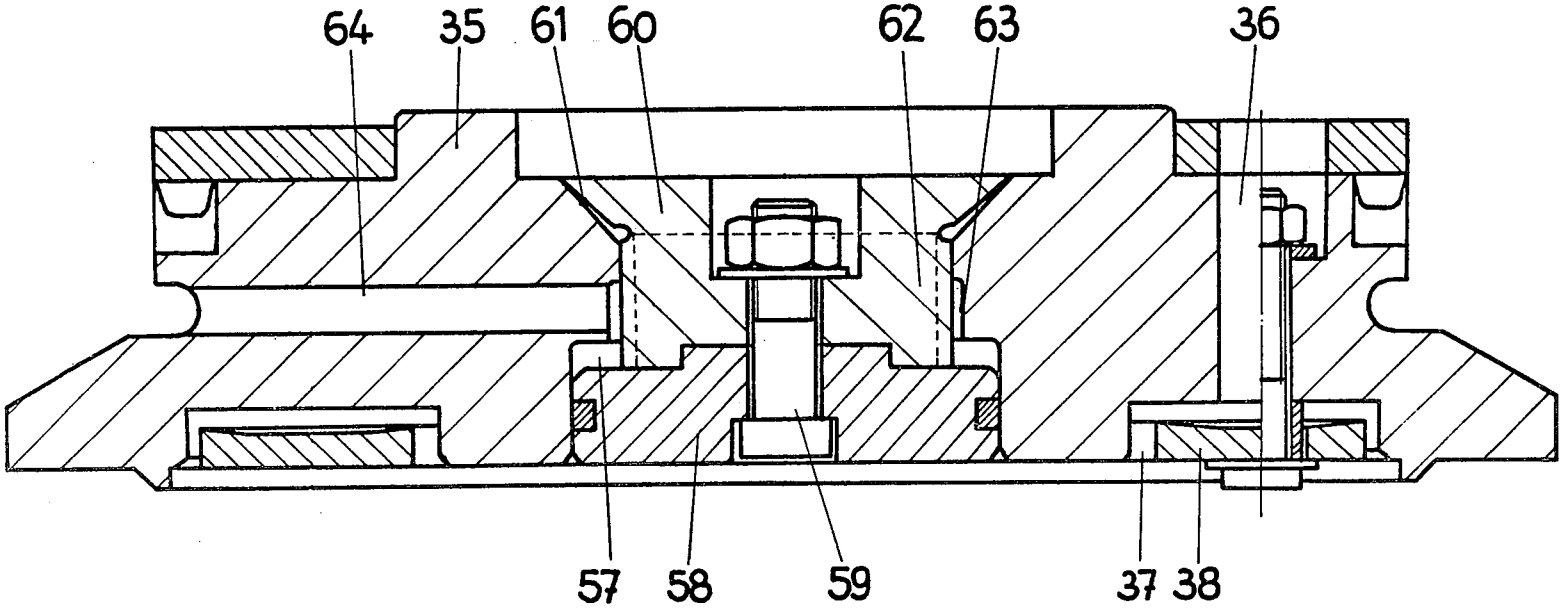
FIG. 3 is an axial section to a further enlarged scale through a part of the coupling according to FIG. 2.

A pin 56, located in a central hole 55 of the housing part 22 bears at its one end upon the hub 50 of the idler ring 47 and at its other end acts upon a valve lifter 58 located sealingly in a central hole 57 (FIG. 3) of the valve piston 35. A valve member 60, with a conical sealing surface, is connected to the valve lifter 58 by a screw fastening 59.

The conical sealing surface cooperates with a corresponding conical valve seating 61 upon the side of the valve piston 35 acted upon by the pressure.

A short valve stem 62, which may have a square cross-section, is connected to the valve lifter side of the valve disc 60. The valve stem 62 has a diameter somewhat smaller than the diameter of the surrounding hole section 63, from which radial ducts 64 extend to emerge at the outer periphery of the valve piston 35 and from there communicate with the chamber 32 formed in the housing part 22. This chamber or the recess comprised therein has an outlet to the atmosphere.

It will be appreciated that in the case of relative axial movement between screw 4 and idler ring 47, the idler ring 47 axially displaces pin 56, together with valve lifter 58 and valve disc 60, whereupon valve disc 60 lifts from its associated valve seating 61. Thus, the compressed air supplied through hole 39 and present in the recess 34 of the cover 33 can flow past the valve disc 60 and valve stem 62 into the hole section 63 and from there by way of the radial ducts 64 into the chamber 32 and subsequently into the atmosphere.

Hence, the pressure above the valve piston 35 in the recess 34 subsides and the resulting force acting upon this side of the piston becomes less than the force exerted in the region of the chamber 40 at the underside of the valve piston 35. Consequently, valve piston 35 rapidly lifts from housing part 22 and thus releases the compressed air present in the pressure chamber between cylinder 17 and piston 18. The compressed air thus released flows into chamber 32 and from there into the atmosphere. This results in a rapid discharge of the pressure chamber and therewith the coupling as a whole, which accordingly is released immediately.

It will be seen that the valve comprising elements 58 and 62 functions as a servo-valve which controls the valve action between valve piston 35 and the annular groove 40 forming the outlet from the pressure chamber. Furthermore, it will be appreciated that the described control also takes place in case of an emergency stop, if the pressure on the upperside of the piston 35 is reduced, e.g. through opening of a valve in the compressed air feed to the hole 39.

All passages for compressed air can have such a large cross-section that the coupling can be operated very quickly in the desired manner. The only requirement is that the surfaces acted upon by compressed air, on both sides of the valve piston, be so matched one to another that when pressure is reduced on the upper side of the piston, at a predetermined pressure difference, valve piston 35 will rapidly lift from the opening of chamber 40 forming the outlet of the pressure chamber.

Obviously, numerous modifications and variations of the present invention are possible in light of the above teachings. It is therefore to be understood that within the scope of the appended claims, the invention may be practiced otherwise than as specifically described herein.

I claim:

1. In a screw press of the type having a screw driven by a flywheel and a pneumatically operated coupling between the flywheel and the screw, the coupling having a pressure chamber supplied with compressed air via a one-way valve and dischargeable by the action of an inertial mass which moves with the screw during its working stroke and inertially relative to the screw at the end of a working stroke to open a discharge orifice in the pressure chamber for releasing the compressed air to the atmosphere, the improvement comprising:

(a) an input chamber for the supply of compressed air;

(b) a valve piston movable in said input chamber, axially of said screw;

(c) a second chamber into which said valve piston projects and being in communication with said pressure chamber, said second chamber having an opening in communication with the atmosphere and selectively covered or uncovered by said valve piston;

(d) at least one through passage in said valve piston for feeding said compressed air from said input chamber to said pressure chamber;

(e) a one-way valve disposed in said through passage for preventing the return of compressed air from said pressure chamber to said input chamber; and (f) servo-valve means operable by the inertial movement of said mass for causing said valve piston to uncover said opening in the second chamber, so as to release the compressed air in said pressure chamber to the atmosphere.

2. A screw press, according to claim 1, wherein said valve piston has a plurality of through passages arranged in a circle coaxial to the valve piston and communicating with an annular groove, said one-way valve comprising a washer movable axially in said groove.

3. A screw press, according to claim 1, wherein said servo-valve is arranged coaxially in said valve piston and comprises a conical valve part cooperable with a corresponding conical valve seat on the valve piston and a valve lifter extending through a bore in the valve piston, such that the free end of the valve lifter is abuttable by means movable by said inertial mass during its inertial movement to lift the conical valve part from said valve seat.

4. A screw press, according to claim 3, further including discharge duct means extending radially from said valve piston below said conical valve seat and extending into said second chamber, so as to discharge the compressed air from said input chamber via the opening in said second chamber when said conical valve part is lifted from its seat.

5. A screw press, according to claims 1, 2, 3 or 4 wherein said inertial mass comprises an annular member having a first toothed formation and further including a second toothed formation fixedly secured to said screw for interengagement with said first toothed formation.

6. A screw press, according to claim 3, further including a pin engageable at one end by said inertial mass, and at the other end engageable by said valve lifter during the inertial movement of said mass.

7. A screw press, according to claims 1, 2, 3, 4, or 6 including an axial stop fixedly secured with respect to said screw for limiting the axial inertial movement of said mass.

* * * * *